US010848888B2

(12) United States Patent
Fujisawa et al.

(10) Patent No.: US 10,848,888 B2
(45) Date of Patent: Nov. 24, 2020

(54) AUDIO DATA PROCESSING DEVICE AND CONTROL METHOD FOR AN AUDIO DATA PROCESSING DEVICE

(71) Applicant: YAMAHA CORPORATION, Hamamatsu (JP)

(72) Inventors: Morishige Fujisawa, Hamamatsu (JP); Kotaro Nakabayashi, Hamamatsu (JP); Yuta Yuyama, Hamamatsu (JP)

(73) Assignee: YAMAHA CORPORATION, Hamamatsu (JP)

( * ) Notice: Subject to any disclaimer, the term of this patent is extended or adjusted under 35 U.S.C. 154(b) by 0 days.

(21) Appl. No.: 16/233,523

(22) Filed: Dec. 27, 2018

(65) Prior Publication Data

US 2019/0200151 A1 Jun. 27, 2019

(30) Foreign Application Priority Data

Dec. 27, 2017 (JP) ..... 2017-251461

(51) Int. Cl.
*H04R 5/00* (2006.01)
*H04S 7/00* (2006.01)
(Continued)

(52) U.S. Cl.
CPC ..... *H04S 7/30* (2013.01); *G10L 19/008* (2013.01); *G10L 21/0208* (2013.01); *G10L 25/51* (2013.01)

(58) Field of Classification Search
CPC . G10L 19/002; G10L 19/0017; G10L 19/008; G10L 19/18; G10L 19/0212; G10L 19/20; G10L 19/025; G10L 21/038; H04S 3/02; H04S 3/004; H04S 3/008; H04S 7/30; H04S 2420/01; H04S 2420/03; H04S 2420/07; H04S 2400/01; H04S 2400/03; H04S 2400/11; H04S 5/00; H04S 5/005; H04S 5/02; G10H 1/361; G10H 2210/301; H04R 5/00; H04R 25/50; H04R 25/502; H04R 25/505; H04R 3/04; H04R 3/06; H04R 3/08
(Continued)

(56) References Cited

U.S. PATENT DOCUMENTS 7,003,467 B1 2/2006 Smith et al.
2002/0090100 A1* 7/2002 Thiede ..... A61F 11/00 381/314
(Continued)

FOREIGN PATENT DOCUMENTS

JP 2010098460 A 4/2010

*Primary Examiner* — Leshui Zhang
(74) *Attorney, Agent, or Firm* — Rossi, Kimms & McDowell LLP

(57) ABSTRACT

An audio data processing device according to an aspect of the present disclosure includes: a sound field effect data generator configured to add sound field effect data to audio data by arithmetic operation processing using a parameter, at least one processor, and at least one memory device that stores a plurality of instructions, which when executed by the at least one processor, causes the at least one processor to operate to: analyze a scene for the audio data, recognize switching of the scene based on an analysis result of the scene, gradually decrease both an input gain and an output gain of the sound field effect data generator, and gradually increase both the input gain and the output gain after changing the parameter.

20 Claims, 5 Drawing Sheets

(51) Int. Cl.
*G10L 19/008* (2013.01)
*G10L 25/51* (2013.01)
*G10L 21/0208* (2013.01)

(58) Field of Classification Search
USPC ..... 381/1, 17–23, 300–311, 27, 61, 59, 77, 381/80–85, 86, 89, 96–110, 118, 119, 381/120, 123; 700/94
See application file for complete search history.

(56) References Cited

U.S. PATENT DOCUMENTS

| | | | | |
|---|---|---|---|---|
| 2010/0091189 | A1 | 4/2010 | Fukuyama | |
| 2010/0290628 | A1* | 11/2010 | Shidoji | H04S 7/30 381/1 |
| 2016/0212563 | A1* | 7/2016 | Yuyama | H04S 7/303 |

* cited by examiner

AUDIO DATA PROCESSING DEVICE AND CONTROL METHOD FOR AN AUDIO DATA PROCESSING DEVICE

CROSS-REFERENCE TO RELATED APPLICATION

The present application claims priority from Japanese Application No. JP 2017-251461 filed on Dec. 27, 2017, the content of which is hereby incorporated by reference into this application.

BACKGROUND OF THE INVENTION

1. Field of the Invention

The present invention relates to an audio data processing device and a control method for an audio data processing device.

2. Description of the Related Art

In Japanese Patent Application Laid-open No. 2010-98460, there is disclosed a configuration in which an audio processing unit configured to perform decoding processing, acoustic processing, delay processing, and other such processing on an audio signal acquired from a tuner mutes sound for a fixed period in order to prevent noise from occurring when switching a sound field effect.

SUMMARY OF THE INVENTION

The present disclosure has an object to achieve switching of a sound field effect that suppresses an occurrence of noise without performing muting processing.

An audio data processing device according to an aspect of the present disclosure includes: a sound field effect data generator configured to add sound field effect data to audio data by arithmetic operation processing using a parameter, at least one processor, and at least one memory device that stores a plurality of instructions, which when executed by the at least one processor, causes the at least one processor to operate to: analyze a scene for the audio data, recognize switching of the scene based on an analysis result of the scene, gradually decrease both an input gain and an output gain of the sound field effect data generator, and gradually increase both the input gain and the output gain after changing the parameter.

A control method for an audio data processing device according to an aspect of the present disclosure is a control method for an audio data processing device including a sound field effect data generator configured to add sound field effect data to audio data by arithmetic operation processing using a parameter. The control method includes: analyzing, with at least one processor operating with a memory device in a device, a scene for the audio data, recognizing, with the at least one processor operating with the memory device in the device, switching of the scene based on an analysis result of the scene, gradually decreasing, with the at least one processor operating with the memory device in the device, both an input gain and an output gain of the sound field effect data generator, changing, with the at least one processor operating with the memory device in the device, the parameter to be used for the arithmetic operation processing, and gradually increasing, with the at least one processor operating with the memory device in the device, both the input gain and the output gain of the sound field effect data generator.

DETAILED DESCRIPTION OF THE INVENTION

First Embodiment

A first embodiment of the present disclosure is described below with reference to the accompanying drawings.

[Audio Data Processing Device 1]

Figure 1:
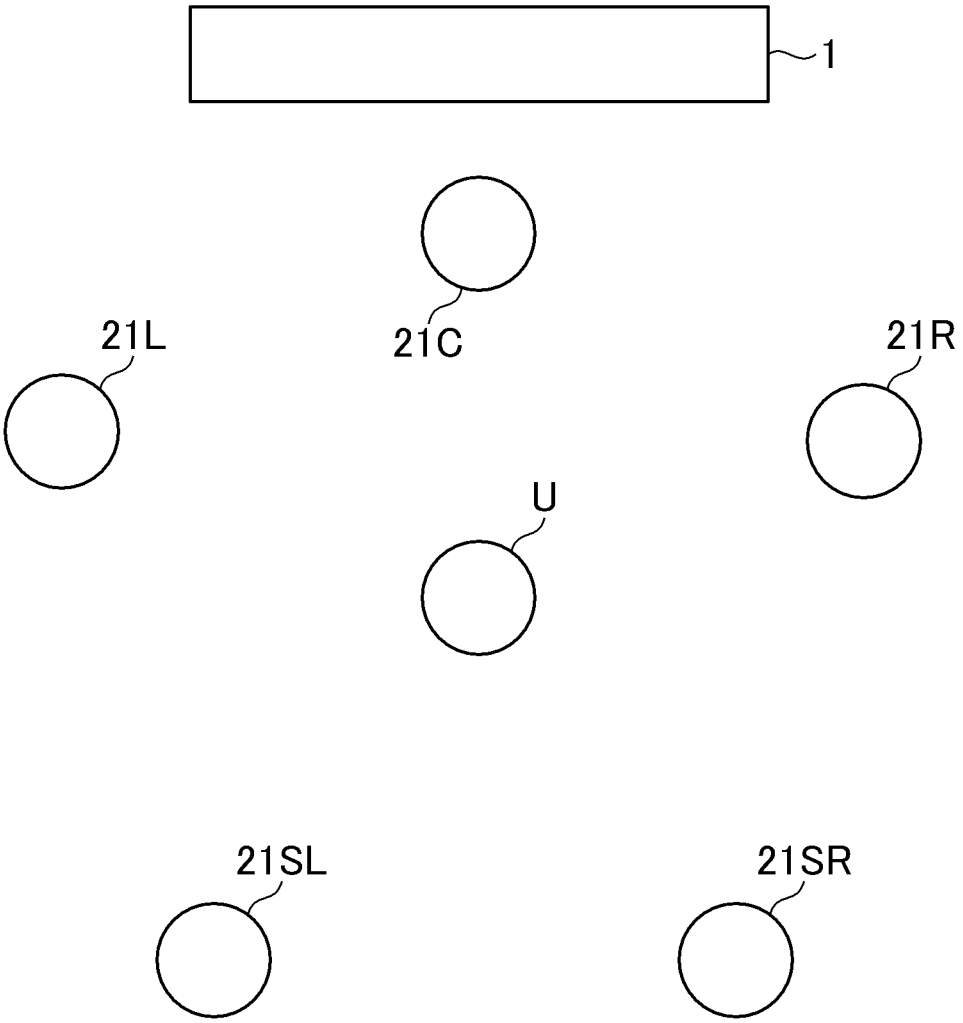
FIG. 1 is a schematic diagram for illustrating a listening environment including an audio data processing device according to a first embodiment of the present disclosure.

FIG. 1 is a schematic diagram of a listening environment including an audio data processing device 1 according to the first embodiment. As illustrated in FIG. 1, in the first embodiment, a front left speaker 21L, a front right speaker 21R, a center speaker 21C, a surround left speaker 21SL, and a surround right speaker 21SR are placed around a listening position U. The front left speaker 21L is set on the front left side of the listening position U, the front right speaker 21R is set on the front right side of the listening position U, the center speaker 21C is set at the center on the front side of the listening position U, the surround left speaker 21SL is set on the left rear side of the listening position U, and the surround right speaker 21SR is set on the right rear side of the listening position U. The front left speaker 21L, the front right speaker 21R, the center speaker 21C, the surround left speaker 21SL, and the surround right speaker 21SR are each connected to the audio data processing device 1 in a wireless or wired manner. The first embodiment is described by taking a 5-ch surround sound system as an example, but the present invention can also be applied to surround sound systems having various number of channels, for example, 2.0-ch, 5.1-ch, 7.1-ch, and 11.2-ch.

Figure 2:
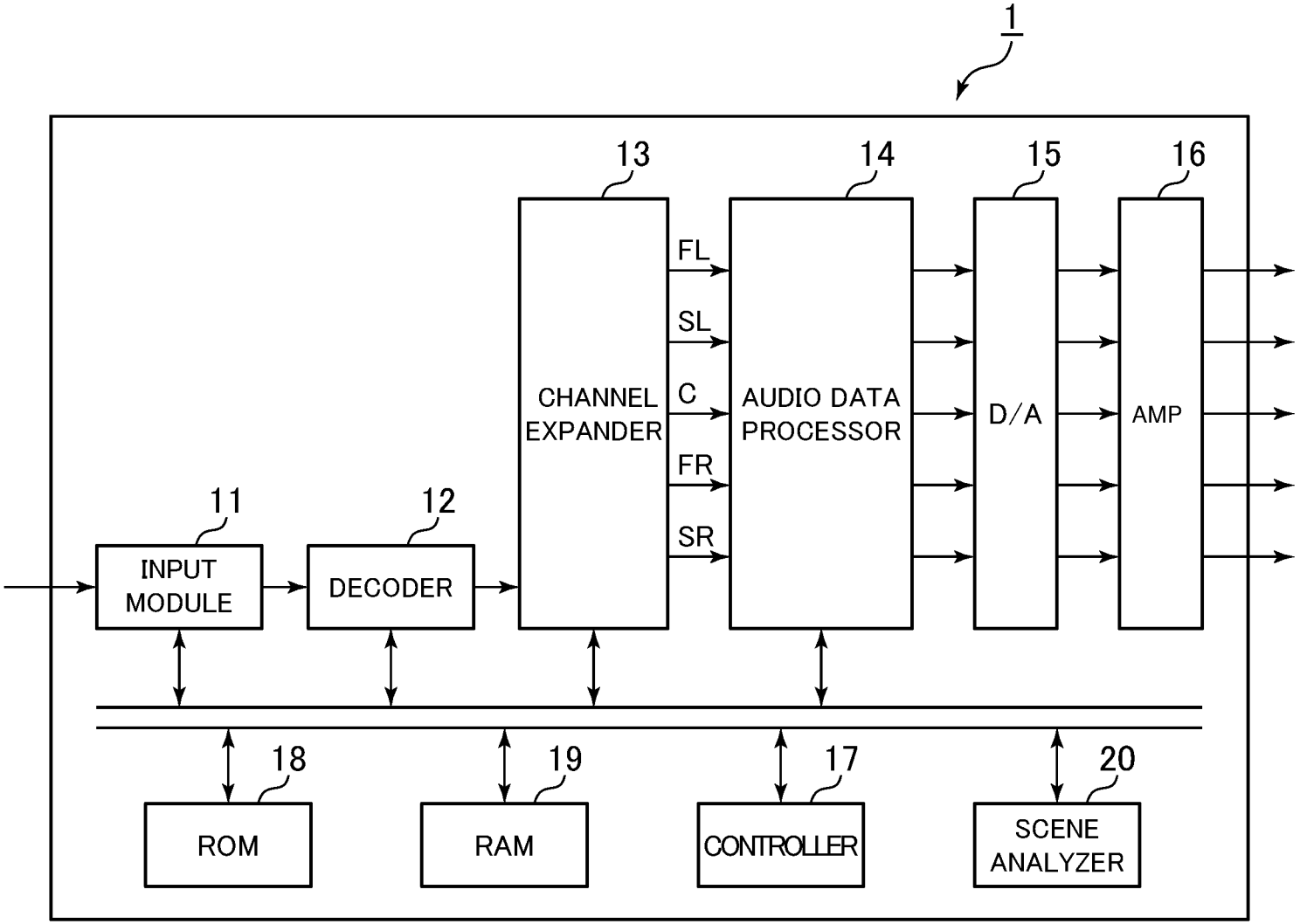
FIG. 2 is a schematic block diagram for illustrating a configuration of the audio data processing device according to the first embodiment.

FIG. 2 is a schematic block diagram for illustrating a configuration of an audio data processing device in the first embodiment. As illustrated in FIG. 2, the audio data processing device 1 according to the first embodiment includes an input module 11, a decoder 12, a channel expander 13, an audio data processor 14, a D/A converter 15, an amplifier 16, a controller 17, a read-only memory (ROM) 18, a random access memory (RAM) 19, and a scene analyzer 20.

The controller 17 reads a program (firmware) for operation, which is stored in the ROM 18, into the RAM 19, and centrally controls the audio data processing device 1. The relevant program for operation may be installed from any one of various recording media including an optical recording medium and a magnetic recording medium, or may be downloaded via the Internet.

The input module 11 acquires an audio signal via an HDMI (trademark) or a network. Examples of schemes for the audio signal include pulse code modulation (PCM), Dolby (trademark), Dolby TrueHD, Dolby Digital Plus, DOLBYATMOS (trademark), AdvancedAudio Coding (AAC) (trademark), DTS (trademark), DTS-HD (trademark) Master Audio, DTS:X (trademark), and Direct Stream Digital (DSD) (trademark), and there are no particular limitations imposed on a type of the scheme. The input module 11 outputs the audio data to the decoder 12.

In the first embodiment, the network includes a wireless local area network (LAN), a wired LAN, and a wide area network (WAN), and functions as a signal transmission path between the audio data processing device 1 and an optical disc player or other such source device.

The decoder 12 is formed of, for example, a digital signal processor (DSP), and decodes the audio signal to extract the audio data therefrom. The first embodiment is described by handling all pieces of audio data as pieces of digital data unless otherwise specified.

The channel expander 13 is formed of, for example, a DSP, and generates pieces of audio data for a plurality of channels corresponding to the front left speaker 21L, the front right speaker 21R, the center speaker 21C, the surround left speaker 21SL, and the surround right speaker 21SR, which are described above, by channel expansion processing. As the channel expansion processing, a known technology (for example, U.S. Pat. No. 7,003,467) can be employed. The generated pieces of audio data for the respective channels are output to the audio data processor 14.

The audio data processor 14 is formed of, for example, a DSP, and performs processing for adding predetermined sound field effect data to the input pieces of audio data for the respective channels based on setting performed by the controller 17.

The sound field effect data is formed of, for example, pseudo reflected sound data generated from the input audio data. The generated pseudo reflected sound data is added to the original audio data to be output.

The D/A converter 15 converts the pieces of audio data for the respective channels into analog signals.

The amplifier 16 amplifies the analog signals output from the D/A converter 15, and outputs the amplified analog signals to the front left speaker 21L, the front right speaker 21R, the center speaker 21C, the surround left speaker 21SL, and the surround right speaker 21SR. With such a configuration, a sound obtained by adding a pseudo reflected sound to a direct sound of audio content is output from each of the speakers to form a sound field that simulates a predetermined acoustic space around the listening position U.

Figure 3:
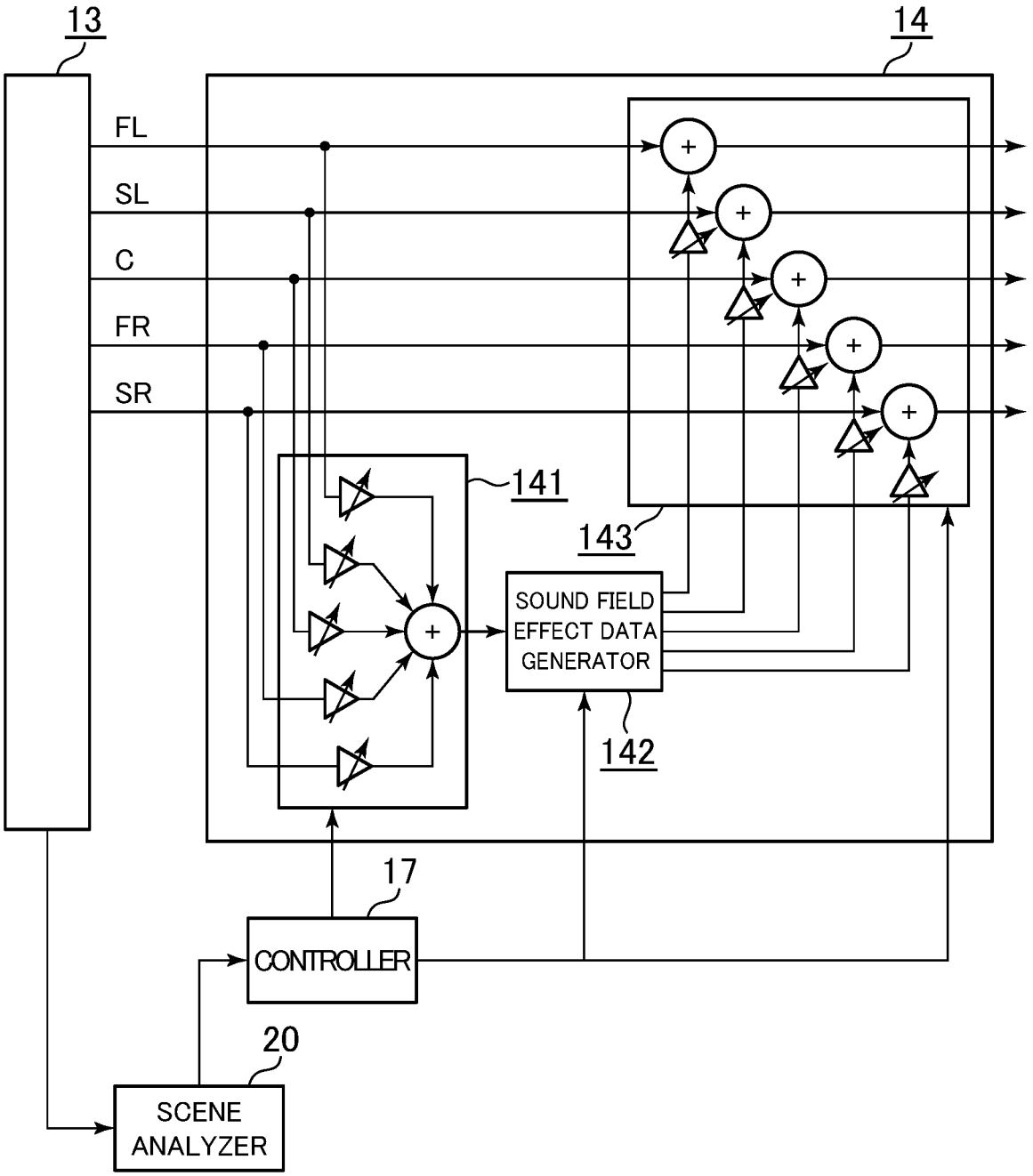
FIG. 3 is a block diagram for illustrating a functional configuration of a controller, an audio data processor, and a scene analyzer in the first embodiment.

FIG. 3 is a block diagram for illustrating a functional configuration of the controller 17, the audio data processor 14, and the scene analyzer 20 in the first embodiment. The audio data processor 14 includes a first addition processor 141, a sound field effect data generator 142, and a second addition processor 143. The first addition processor 141 adjusts an input gain of the sound field effect data generator 142, and the second addition processor 143 adjusts an output gain of the sound field effect data generator 142.

The first addition processor 141 down mixes the pieces of audio data for the respective channels with predetermined gains into a monaural signal. The gains of the respective channels are set by the controller 17. The configuration may include a plurality of first addition processors 141, each of which is configured to output the down mixed monaural signal.

The sound field effect data generator 142 uses various kinds of parameters to perform arithmetic operation processing on the monaural signal output from the first addition processor 141 based on an instruction from the controller 17 to generate the sound field effect data. When there are a plurality of first addition processors 141 and a plurality of monaural signals are output therefrom, the sound field effect data generator 142 performs the arithmetic operation processing on the plurality of monaural signals to generate a plurality of pieces of sound field effect data. The sound field effect data generator 142 adds the generated pieces of sound field effect data to the pieces of audio data for the respective channels via the second addition processor 143 described later. Examples of the parameters to be used for the arithmetic operation processing by the sound field effect data generator 142 include a gain ratio among the respective channels, a delay time, a filter coefficient, and a large number of other such parameters. The sound field effect data generator 142 executes the arithmetic operation processing using the various kinds of parameters including the gain ratio, the delay time, and the filter coefficient based on a command signal output from the controller 17.

The second addition processor 143 adds the pieces of sound field effect data generated by the sound field effect data generator 142 to the pieces of audio data for the respective channels transmitted from the channel expander 13. The gains of the respective channels are set by the controller 17.

The scene analyzer 20 performs a scene analysis for the audio data. In the first embodiment, examples of types of scenes include a "movie scene", a "music scene", a "quiet scene", a "speech-oriented scene", a "background-music-oriented scene", a "sound-effects-oriented scene", and a "bass-range-oriented scene".

The scene analyzer 20 uses machine learning to determine which one of the above-mentioned scenes matches the audio data output from the channel expander 13. As a specific example, the scene analyzer 20 stores information relating to thousands to tens of thousands of patterns of audio data. This information includes features of the respective scenes and information relating to which one of the patterns matches the scene. The features of the respective scenes include information obtained by integrating information on the gain ratio, information on frequency characteristics, information on a channel configuration, and other such information. Then, the scene analyzer 20 uses, for example, pattern recognition performed by a support vector machine to determine which scene matches the audio data output from the channel expander 13. The scene analyzer 20 outputs an analysis result thereof to the controller 17.

When recognizing switching of the scene based on the analysis result obtained by the scene analyzer 20, the controller 17 gradually decreases both the input gain and the output gain of the sound field effect data generator 142. Specifically, when recognizing the switching of the scene, the controller 17 gradually decreases the gains of the respective channels in the first addition processor 141 and the second addition processor 143 so as to finally have as extremely small a value as, for example, −60 dB.

The controller 17 outputs a command signal based on the analysis result of the scene obtained by the scene analyzer 20 to the sound field effect data generator 142. The command signal includes an instruction relating to the setting of the various kinds of parameters to be used for the arithmetic operation processing by the sound field effect data generator 142. Examples of the various kinds of parameters include the gain ratio among the respective channels, the filter coefficient, and the delay time. The sound field effect data generator 142 changes the various kinds of parameters based on the command signal.

After the various kinds of parameters are changed by the sound field effect data generator 142, the controller 17 gradually increases the input gain and the output gain of the sound field effect data generator 142 to a state before scene switching. That is, the controller 17 gradually increases the gains of the respective channels in the first addition processor 141 and the second addition processor 143 to the state before the scene switching.

With the above-mentioned configuration, the pieces of audio data to which the pieces of sound field effect data have been added are converted into analog signals by the D/A converter 15, amplified by the amplifier 16, and then output to the respective speakers. The pieces of audio data are thus output, to thereby form the sound field that simulates a predetermined acoustic space around the listening position U.

[Control Method for Audio Data Processing Device 1]

Figure 4:
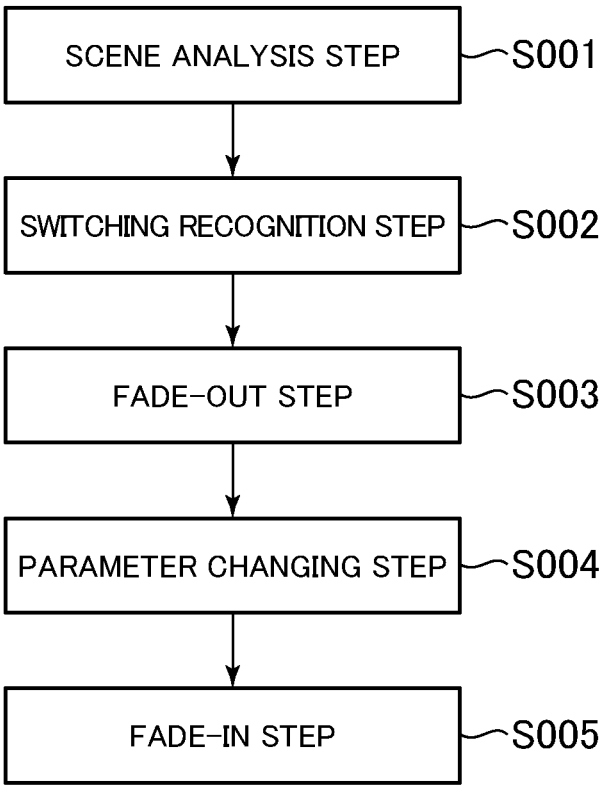
FIG. 4 is a flow chart for illustrating a control method for an audio data processing device according to the first embodiment.

FIG. 4 is a flow chart for illustrating a control method for an audio data processing device 1 according the first embodiment. Now, with reference to FIG. 4, the control method for the audio data processing device 1 according to the first embodiment is described.

[Scene Analysis Step S001]

When the pieces of audio data for the respective channels are output from the channel expander 13, the scene analyzer 20 analyzes what kind of scene is expressed by those pieces of audio data. The scene analysis can be performed by the scene analyzer 20 through use of the machine learning as described above. Examples of the scenes in this embodiment include the "movie scene", the "music scene", the "quiet scene", the "speech-oriented scene", the "background-music-oriented scene", the "sound-effects-oriented scene", and the "bass-range-oriented scene".

As methods of switching the scene, the scene switching of a normal pattern and the scene switching of an exceptional pattern are provided. In regard to the scene switching of the exceptional pattern, for example, exceptional patterns are stored in the ROM 18 or stored in the scene analyzer 20 in advance.

In the first embodiment, the ROM 18 is assumed to store, as an example of the scene switching of the exceptional patterns, three patterns in which the state after the switching is the "bass-range-oriented scene", in which the state after the switching is the "music scene", and in which the states before and after the switching are a combination of the "quiet scene" and the "speech-oriented scene".

First, as an example of the scene switching of the normal pattern, a description is given of an example in which the scene analyzer 20 has determined that the scene at a first time point T1 is the "music scene" and the scene at a second time point T2 after the switching is the "movie scene".

[Switching Recognition Step S002]

The controller 17 is assumed to receive, at the first time point T1, a determination result indicating that the scene at the first time point T1 is the "music scene" from the scene analyzer 20. The controller 17 stores the determination result even at the second time point T2.

The controller 17, which has received a determination result indicating that the scene at the second time point T2 is the "movie scene" from the scene analyzer 20, recognizes that the scene is to be switched from the "music scene" to the "movie scene".

The controller 17 also determines whether or not the current scene switching belongs to the exceptional pattern stored in the ROM 18 in advance. In the current scene switching from the "music scene" to the "movie scene", the state after the switching is neither the "bass-range-oriented scene" nor the "music scene", and the states before and after the switching are not the combination of the "quiet scene" and the "speech-oriented scene". Therefore, the controller 17 determines that the current scene switching is the scene switching of the normal pattern, which belongs to none of the above-mentioned exceptional patterns.

In this case, it is assumed that, in the "music scene", the gain ratio among the respective channels is a first ratio R1, the filter coefficient is a first filter coefficient F1, and the delay time is a first delay time D1. In addition, it is assumed that, in the "movie scene", the gain ratio among the respective channels is a second ratio R2, the filter coefficient is a second filter coefficient F2, and the delay time is a second delay time D2.

In the first embodiment, the first ratio R1 and the second ratio R2 are different from each other, the first filter coefficient F1 and the second filter coefficient F2 are different from each other, and the first delay time D1 and the second delay time D2 are different from each other.

[Fade-out Step S003]

The controller 17 gradually decreases a gain G1 in the normal state of the first addition processor 141 and the second addition processor 143 to as extremely low a predetermined gain G0 as, for example, −60 dB. In that case, the controller 17 gradually decreases the gain G1 in the normal state of the first addition processor 141 and the second addition processor 143 to the predetermined gain G0 over a predetermined time period (first time period) of, for example, 50 msec. A transition from the gain G1 in the normal state to the predetermined gain G0 may be a linear transition for changing the gain in proportion to passage of time, or may be a curved transition that does not change the gain in proportion to the passage of time.

Under the control performed on the first addition processor 141 and the second addition processor 143 by the controller 17, the pseudo reflected sound that has contributed to a sound field effect serving as the current "music scene" is caused to fade out, and a sound obtained by adding a slight pseudo reflected sound to the direct sound to be output from the channel expander 13 is output from the amplifier 16.

In this manner, the controller 17 is configured to not only gradually decrease the gain of the second addition processor 143 on the subsequent stage side of the sound field effect data generator 142 but also gradually decrease the gain of the first addition processor 141 on the previous stage side of the sound field effect data generator 142, to thereby be able to suppress an occurrence of noise. A reason therefor is described below.

First, the audio data yet to be output to the second addition processor 143 remains in the sound field effect data generator 142 due to buffer processing corresponding to the first delay time D1 in the scene before the switching. Therefore, when the various kinds of parameters in the sound field effect data generator 142 are changed without gradually decreasing the gain of the first addition processor 141, discontinuous points occur at a boundary between the audio data remaining in the sound field effect data generator 142 and the audio data newly input from the first addition processor 141 to the sound field effect data generator 142. Further, the second addition processor 143 has already finished performing the fade-out step S003 at a timing at which this boundary region is output to the second addition processor 143, and hence the relevant discontinuous points are output to the D/A converter 15 without being subjected to fade processing.

However, as described in the first embodiment, with such a configuration as to gradually decrease the gain of the first addition processor 141 as well in the fade-out step S003 and gradually increase the gain of the first addition processor 141 in a fade-in step S005 described later, it is possible to perform the fade processing on the above-mentioned discontinuous points as well, and to suppress the occurrence of noise ascribable to the scene switching in the sound output from the respective speakers.

Figure 5:
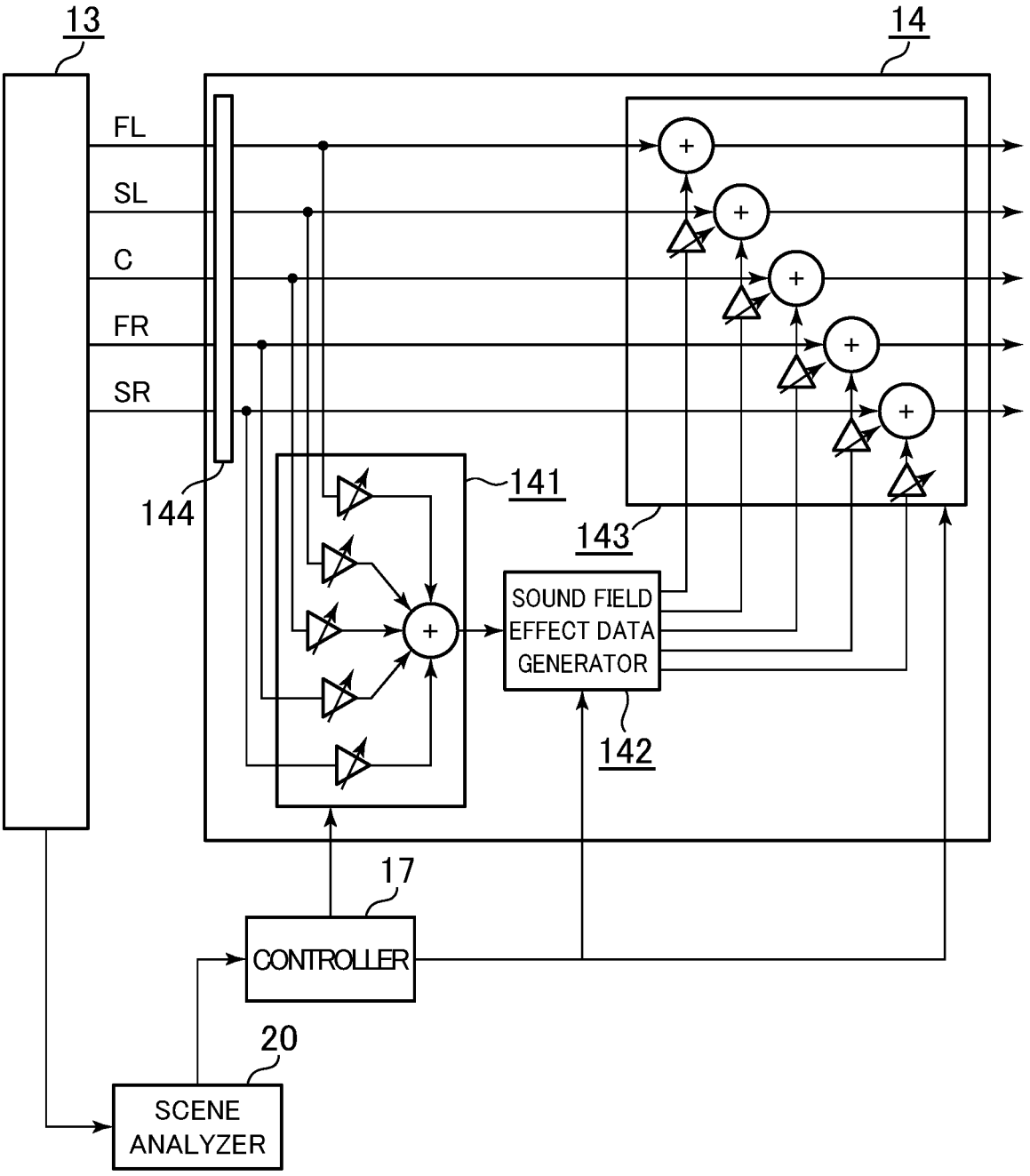
FIG. 5 is a block diagram for illustrating a functional configuration of the controller, the audio data processor, and the scene analyzer in the first embodiment.

As illustrated in FIG. 5, with a configuration provided with a buffer 144 at the subsequent stage of the channel expander 13 and the previous stage of the first addition processor 141, it is possible to effectively perform sound field switching corresponding to the scene. That is, with the configuration provided with the buffer 144, the scene analyzer 20 can recognize the switching of the scene, and the controller 17 can perform the above-mentioned fade-out step S003 before the audio data before the scene switching is input to the first addition processor 141, to thereby be able to more effectively perform the sound field switching corresponding to the scene. The buffer 144 may be provided inside the audio data processor 14, and may be provided outside the audio data processor 14 and between the channel expander 13 and the audio data processor 14.

[Parameter Changing Step S004]

When the controller 17 recognizes that the gains of the first addition processor 141 and the second addition processor 143 have been decreased to the predetermined gain G0, the controller 17 transmits, to the sound field effect data generator 142, a command signal for instructing the sound field effect data generator 142 to change the various kinds of parameters.

Specifically, the controller 17 transmits, to the sound field effect data generator 142, a command signal for instructing the sound field effect data generator 142 to change the gain ratio among the respective channels to be used for the arithmetic operation processing in the sound field effect data generator 142 from the first ratio R1 to the second ratio R2, change the filter coefficient from the first filter coefficient F1 to the second filter coefficient F2, and change the delay time from the first delay time D1 to the second delay time D2.

As the method of recognizing that the gains of the first addition processor 141 and the second addition processor 143 have been decreased to the predetermined gain G0, the controller 17 may actually detect the gains of the first addition processor 141 and the second addition processor 143, or may recognize that the first gain G1 has been changed to a predetermined value due to the fact that the above-mentioned first time period has elapsed.

The sound field effect data generator 142, which has received the command signal from the controller 17, changes the various kinds of parameters based on the command signal.

[Fade-in Step S005]

When the sound field effect data generator 142 completes changing the various kinds of parameters, the controller 17 gradually increases the gains of the first addition processor 141 and the second addition processor 143 from the predetermined gain G0 to the gain G1 in the normal state.

In that case, the controller 17 gradually increases the gains of the first addition processor 141 and the second addition processor 143 from the predetermined gain G0 to the gain G1 in the normal state over a predetermined time period (second time period), for example, 100 msec. A transition from the predetermined gain G0 to the gain G1 in the normal state may be a linear transition for changing the gain in proportion to passage of time, or may be a curved transition that does not change the gain in proportion to the passage of time.

Under the control performed on the first addition processor 141 and the second addition processor 143 by the controller 17, the pseudo reflected sound that has faded out is caused to fade in as a pseudo reflected sound suitable for the "movie scene" being a new scene, and a sound obtained by adding a new pseudo reflected sound to the direct sound to be output from the channel expander 13 is output from the amplifier 16.

With such a control method, it is possible to achieve the switching of a sound field effect sound corresponding to the scene switching without performing muting processing.

First, the gain of the second addition processor 143 on the subsequent stage side of the sound field effect data generator 142 is gradually decreased and gradually increased, to thereby be able to suppress an occurrence of an edge in the audio data to which the sound field effect data has been added even when, for example, there is a change in delay time due to a scene change. As a result, it is possible to suppress the occurrence of noise in the sound output from the respective speakers.

In addition, the control method may involve not only gradually decreasing and gradually increasing the gain of the second addition processor 143 on the subsequent stage side of the sound field effect data generator 142 as described above but also gradually decreasing and gradually increasing the gain of the first addition processor 141 on the previous stage side of the sound field effect data generator 142, to thereby be able to suppress the occurrence of noise.

That is, with the control method involving gradually decreasing and gradually increasing the gain of the first addition processor 141, it is possible to reduce an influence of the discontinuous points at the boundary between the audio data remaining in the sound field effect data generator 142 due to the buffer processing and the audio data newly input from the first addition processor 141 to the sound field effect data generator 142, to thereby be able to suppress the occurrence of the noise ascribable to the scene switching in the sound output from the respective speakers.

The above-mentioned control method also eliminates the requirement to provide a configuration that uses two or more sound field effect data generators to perform the scene switching by switching output therefrom, and it is possible to achieve the scene switching that suppresses the occurrence of noise through use of one sound field effect data generator 142. Therefore, it is possible to achieve reduction in size of the audio data processing device 1.

In the first embodiment, it is required to change at least two operation parameters of the gain ratio, the filter coefficient, and the delay time during the transition from the first the scene to the second the scene, and hence the control method includes the fade-out step S003 of gradually decreasing the gains of the first addition processor 141 and the second addition processor 143 and the fade-in step S005 of gradually increasing the gains of the first addition processor 141 and the second addition processor 143.

However, when only one of the operation parameters (for example, only the gain ratio, the filter coefficient, or only the delay time) suffices for the scene switching, the configuration may involve changing only the operation parameter to be gradually changed from the first parameter value to the second parameter value instead of performing the fade-out step S003 and the fade-in step S005, which have been described above.

As described in the first embodiment, nevertheless, in the case of controlling the changing of at least two operation parameters, it is more desired to employ the control method including the fade-out step S003 and the fade-in step S005, which have been described above for the gains of the first addition processor 141 and the second addition processor 143, which is more rational and simpler control, than to perform complicated control on individual parameters.

Now, as a method of switching the scene, the method of switching for the exceptional pattern is described.

First, a description is given of a case in which the state after the switching is the "bass-range-oriented scene".

The controller 17 recognizes that the current scene switching belongs to the exceptional pattern stored in the ROM 18 when acquiring, from the scene analyzer 20, the determination result indicating that the scene at the second time point T2 after the switching is the "bass-range-oriented scene", irrespective of the determination result of the scene at the first time point T1 before the scene switching.

In the audio data, when discontinuous points occur in an audio data component relating to a bass-range sound at, for example, 200 Hz, noise is liable to occur. Therefore, when the scene after the switching is the "bass-range-oriented scene" in which the bass-range sound at a frequency equal to or lower than 200 Hz is contained at a ratio equal to or higher than a predetermined ratio, the controller 17 determines to set a time period required for the above-mentioned fade-in step S005, namely, a time period required for gradually increasing the gains of the first addition processor 141 and the second addition processor 143, to a time period longer than the second time period required in the normal pattern, for example, 120 msec.

The noise occurs at the time of the fade-in step S005 after the switching. Therefore, the controller 17 determines to set a time period required for the above-mentioned fade-out step S003, namely, a time period required for gradually decreasing the gains of the first addition processor 141 and the second addition processor 143, to a time period equal to or shorter than the first time period required in the normal pattern, for example, 30 msec.

The controller 17 sets the time period required for the fade-out step S003 to the time period shorter than the first time period, to thereby allow the control that prevents the time period required for the entire fade processing, which includes the time period required for the fade-out step S003 and the time period required for the fade-in step S005, from becoming too long, which is desirable.

Next, a description is given of a case in which the state after the switching is the "music scene", in which a signal component for music is contained at a ratio equal to or higher than a predetermined ratio.

The controller 17 recognizes that the current scene switching belongs to the exceptional pattern stored in the ROM 18 when acquiring, from the scene analyzer 20, the determination result indicating that the scene at the second time point T2 after the switching is the "music scene", irrespective of the determination result of the scene at the first time point T1 before the scene switching.

When the sound field effect sound is switched at a midpoint of a musical piece after the current scene is switched to the "music scene", a listener tends to feel discomfort. Therefore, when the scene after the switching is the "music scene", the controller 17 determines to set the above-mentioned time period required for the fade-out step S003 to a time period shorter than the first time period required in the normal pattern, for example, 30 msec.

Further, the controller 17 also determines to set the above-mentioned time period required for the fade-in step S005 to a time period shorter than the second time period required in the normal pattern, for example, 80 msec.

Next, a description is given of the case of the combination in which the state before the switching is the "quiet scene" and the state after the switching is the "speech-oriented scene".

The controller 17 recognizes that the current scene switching belongs to the exceptional pattern stored in the ROM 18 when acquiring, from the scene analyzer 20, the determination result indicating that the scene at the first time point T1 before the scene switching is the "quiet scene" and the scene at the second time point T2 after the switching is the "speech-oriented scene".

The "quiet scene" and the "speech-oriented scene" are both quiet scenes, and hence noise hardly occurs even when the above-mentioned fade processing is performed for a short period of time. However, in that case, there is a fear that only a speech component may become noise. Therefore, the controller 17 determines to extract only a speech component in the scene switching in the exceptional pattern, and to cause a fade processing time period for the speech component to become longer than a fade processing time period for a sound component other than the speech component.

As the extraction of a speech component, for example, the sound field effect data generator 142 analyzes frequency components of from, for example, 0.2 kHz to 8 kHz, in pieces of audio data for the respective channels to extract a speech component.

As a specific example of the fade processing time period, the controller 17 determines to set the time period required for the fade-out step S003 regarding a signal component other than the speech component to 30 msec, which is shorter than the first time period required in the normal pattern.

Further, the controller 17 determines to set the time period required for the fade-in step S005 regarding a signal component other than the speech component to 80 msec, which is shorter than the second time period required in the normal pattern.

The controller 17 determines to set the time period required for the fade-out step S003 regarding a speech component to a time period longer than the time period required for the fade-out step S003 regarding a signal component other than the speech component. For example, the controller 17 determines to set the time period required for the fade-out step S003 regarding the speech component to the first time period required in the normal pattern.

The controller 17 determines to set the time period required for the fade-in step S005 regarding a speech component to a time period longer than the time period required for the fade-in step S005 regarding a signal component other than the speech component. For example, the controller 17 determines to set the time period required for the fade-in step S005 regarding the speech component to the second time period required in the normal pattern.

In this manner, by performing the above-mentioned scene switching of the exceptional pattern, it is possible to achieve a trade-off balance between performing the fade processing for as short a time period as possible and switching the scene without causing as much noise as possible.

The time periods relating to the above-mentioned fade processing, the values of the gains targeted in the fade-out step S003, the numerical values of various kinds of frequencies, and other such values are merely examples, and this disclosure is not limited to the above-mentioned specific numerical values.

While there have been described what are at present considered to be certain embodiments of the invention, it will be understood that various modifications may be made thereto, and it is intended that the appended claims cover all such modifications as fall within the true spirit and scope of the invention.

What is claimed is:

1. An audio data processing device, comprising:

an audio data processor configured to add sound field effect data to audio data by arithmetic operation processing using one or more parameters;

at least one processor; and at least one memory device that stores a plurality of instructions, which when executed by the at least one processor, causes the at least one processor to operate to:

analyze a scene associated with the audio data;

recognize switching of the scene based on an analysis result of the scene;

gradually decrease both an input gain and an output gain of the audio data processor, after the switching of the scene is recognized;

change at least one of the one or more parameters, after the input gain and an output gain of the audio data processor are gradually decreased, wherein the one or more parameters include a gain ratio, a filter coefficient, and a delay time; and gradually increase both the input gain and the output gain after changing the at least one of the one or more parameters.

2. The audio data processing device according to claim 1, wherein the audio data includes a plurality of channels, wherein the audio data processor is configured to perform the arithmetic operation processing using the one or more parameters on the plurality of channels, and wherein the at least one processor is configured to control the input gain for the plurality of channels and the output gain for the plurality of channels.

3. The audio data processing device according to claim 1, wherein the at least one processor is configured to change at least any two of the gain ratio, the filter coefficient, or the delay time in the switching of the scene.

4. The audio data processing device according to claim 1, wherein the at least one processor is configured to determine a time period required for gradually decreasing the input gain and the output gain depending on a type of the scene after the switching.

5. The audio data processing device according to claim 4, wherein the at least one processor is configured to set, when the scene after the switching contains a speech component, the time period required for gradually decreasing the input gain and the output gain for the speech component to a time period longer than the time period required for gradually decreasing the input gain and the output gain for a component other than the speech component.

6. The audio data processing device according to claim 1, wherein the at least one processor is configured to determine a time period required for gradually increasing the input gain and the output gain depending on a type of the scene after the switching.

7. The audio data processing device according to claim 6, wherein the at least one processor is configured to set, when the scene after the switching contains a speech component, the time period required for gradually increasing the input gain and the output gain for the speech component to a time period longer than the time period required for gradually increasing the input gain and the output gain for a component other than the speech component.

8. The audio data processing device according to claim 1, wherein the at least one processor is configured to gradually decrease the input gain and the output gain over a first time period and gradually increase the input gain and the output gain over a second time period in the switching of the scene in a normal pattern.

9. The audio data processing device according to claim 8, wherein the at least one processor is configured to set, when a sound at a frequency equal to or lower than 200 Hz is contained at a ratio equal to or higher than a predetermined ratio in the scene after the switching, a time period required for gradually increasing the input gain and the output gain to a time period longer than the second time period.

10. The audio data processing device according to claim 8, wherein the at least one processor is configured to set, when a sound at a frequency equal to or lower than 200 Hz is contained at a ratio equal to or higher than a predetermined ratio in the scene after the switching, a time period required for gradually decreasing the input gain and the output gain to a time period longer than the first time period.

11. The audio data processing device according to claim 8, wherein the at least one processor is configured to set, when a signal component for music is contained at a ratio equal to or higher than a predetermined ratio in the scene after the switching, a time period required for gradually decreasing the input gain and the output gain to a time period shorter than the first time period.

12. The audio data processing device according to claim 8, wherein the at least one processor is configured to set, when a signal component for music is contained at a ratio equal to or higher than a predetermined ratio in the scene after the switching, a time period required for gradually increasing the input gain and the output gain to a time period shorter than the second time period.

13. The audio data processing device according to claim 1, further comprising:

a first addition processor configured to adjust the input gain of the sound field effect data generator, and a buffer provided at a previous stage of the first addition processor.

14. A control method for an audio data processing device including an audio data processor configured to add sound field effect data to audio data by arithmetic operation processing using one or more parameters, the method being executable by a processor, the method comprising:

analyzing a scene associated with the audio data;

recognizing switching of the scene based on an analysis result of the scene;

gradually decreasing both an input gain and an output gain of the audio data processor, after the switching of the scene is recognized;

changing the one or more parameters to be used for the arithmetic operation processing, after the input gain and an output gain of the audio data processor are gradually decreased, wherein the one or more parameters include a gain ratio, a filter coefficient, and a delay time; and gradually increasing both the input gain and the output gain of the audio data processor.

15. The control method for an audio data processing device according to claim 14, wherein the audio data includes a plurality of channels, the method further comprising:

performing the arithmetic operation processing using the one or more parameters on the plurality of channels; and controlling the input gain for the plurality of channels and the output gain for the plurality of channels.

16. The control method for an audio data processing device according to claim 14, wherein the one or more parameters include a gain ratio, a filter coefficient, and a delay time, the method further comprising changing at least any two of the gain ratio, the filter coefficient, or the delay time in the switching of the scene.

17. The control method for an audio data processing device according to claim 14, the method further comprising determining a time period required for gradually decreasing the input gain and the output gain depending on a type of the scene after the switching.

18. The control method for an audio data processing device according to claim 14, the method further comprising determining a time period required for gradually increasing the input gain and the output gain depending on a type of the scene after the switching.

19. The control method for an audio data processing device according to claim 14, the method further comprising gradually decreasing, with the at least one processor operating with the memory device in the audio data processing device, the input gain and the output gain over a first time period and gradually increasing, with the at least one processor operating with the memory device in the audio data processing device, the input gain and the output gain over a second time period in the switching of the scene in a normal pattern.

20. The control method for an audio data processing device according to claim 19, wherein, when a sound at a frequency equal to or lower than 200 Hz is contained at a ratio equal to or higher than a predetermined ratio in the scene after the switching, a time period required for gradually increasing the input gain and the output gain to a time period longer than the second time period.

* * * * *